US006384490B1

(12) United States Patent
Birzl et al.

(10) Patent No.: US 6,384,490 B1
(45) Date of Patent: May 7, 2002

(54) PROCESS WHEN STARTING THE ENGINE OF A VEHICLE

(75) Inventors: Willibald Birzl, Karlshuld; Matthias Herger, Puchheim, both of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/488,824

(22) Filed: Jan. 21, 2000

(30) Foreign Application Priority Data

Jan. 23, 1999 (DE) ..... 199 02 638

(51) Int. Cl.[7] ..... F02N 17/00

(52) U.S. Cl. ..... 307/10.3; 307/9.1; 307/10.1; 307/10.6; 340/426

(58) Field of Search ..... 307/9.1, 10.1, 307/10.3, 10.6; 701/70; 340/426

(56) References Cited

U.S. PATENT DOCUMENTS 5,614,883 A * 3/1997 Dery et al. ..... 340/458
5,646,457 A * 7/1997 Vakavtchiev ..... 307/10.6
6,012,007 A * 1/2000 Fortune et al. ..... 701/45

FOREIGN PATENT DOCUMENTS

| | | | |
|---|---|---|---|
| DE | 196 29 426 | 1/1998 | |
| DE | 196 32 863 | 2/1998 | |
| JP | 01-120465 | 5/1989 | |
| JP | 05-310119 | 11/1993 | |
| JP | 053101119 | * 11/1993 | ..... B60T/17/18 |

* cited by examiner

*Primary Examiner*—Josie Ballato
*Assistant Examiner*—Robert L. DeBeradinis
(74) *Attorney, Agent, or Firm*—Crowell & Moring LLP

(57) ABSTRACT

A process to be performed when starting the engine of a vehicle with an automated or automatic transmission and a vehicle brake which can be operated by way of external power is provided. In order to secure the vehicle against rolling away without any impairment of the operating comfort, situations are detected which express the imminent starting of the engine. The vehicle brake, particularly the service brake, is operated by way of external power before the starting of the engine for securely blocking the vehicle.

21 Claims, 2 Drawing Sheets

PROCESS WHEN STARTING THE ENGINE OF A VEHICLE

BACKGROUND AND SUMMARY OF THE INVENTION

This application claims the priority of German Application No. 199 02 638.6, filed Jan. 23, 1999, the disclosure of which is expressly incorporated by reference herein.

The invention relates to a process performed when starting an engine of a vehicle equipped with an automated or automatic transmission and a vehicle brake.

In vehicles having automated standard transmissions, the first gear is often engaged automatically to increase the roll-away resistance when the engine is switched off. This condition must then be eliminated when the vehicle is started because it would otherwise result in an unintentional movement of the vehicle. In such a case, the driver must first ascertain whether the neutral position has been selected or the transmission line has been interrupted. If this is not so, he must first select the neutral position or interrupt the transmission line. If he does not carry out this step, the engine cannot be started for safety reasons. However, if he does carry out this step, he must often operate the service brake for starting the engine in order to keep the vehicle from rolling away.

From German Patent document DE 196 32 863 A1, a motor vehicle is known having a parking brake, in which case, depending on the operating condition of the vehicle, a hydraulic or electro-mechanical operating mode can be selected. For example, when the vehicle is used, the vehicle brake is operated in the hydraulic mode and, after the driver has left the vehicle, it is operated in the electromechanical mode. A decision with respect to a change-over can take place based on a door operation, a driver seat occupation detection or a detection of an ignition activation. However, automatic operation of a brake, which was previously not operated, is not described.

In contrast, German Patent document 196 29 426 A1 describes an automated parking brake, in which case, after the end of the driving operation, the parking brake is automatically operated. However, when the driving operation is started, the parking brake is released again.

It is not possible with the above-mentioned devices and processes, however, to achieve a situation in which the vehicle is not secured by means of a vehicle brake (particularly a parking brake) while the vehicle is switched off, but nevertheless ensuring a secure starting of the vehicle.

It is therefor an object of the present invention to provide a simple process for increasing driving safety and operating comfort when starting an engine.

This object is achieved by a process to be performed when starting the engine of a vehicle with an automated or automatic transmission and a vehicle brake, which can be operated by way of external power. The process is characterized in that situations are detected which express the imminent starting of the engine, and then the vehicle brake, particularly the service brake or the parking brake, is operated by way of external power before starting the engine for secure blocking of the vehicle.

It is the essence of the present invention that an imminent starting of the engine be detected. Then, before the engine is started, the vehicle brake, which was first released, is operated by way of external power for secure blocking of the vehicle.

As the result of the automatic operation of the vehicle brake, particularly the parking brake, before the engine is started, the vehicle is secured against rolling away during the starting operation—thus, until the driver's wish is detected. This measure can be used particularly advantageously also in the case of automatic transmissions with converters, since then, when the engine is started, a forward or reverse driving position may also be engaged, which results in a certain creeping tendency.

The imminent starting of the vehicle can be determined, for example, by way of the unlocking of the vehicle, the opening of the vehicle door, a driver seat occupation detection and/or an operation of the ignition lock or the ignition/start determination. In particular, the operation of a starting or ignition system is closely connected to an imminent engine start.

In the case of automated standard transmissions, there is the additional danger that—particularly when the selector levers are locked—, another driving position than the engaged driving position is indicated. Thus, it is possible that, when the driver door is opened, the neutral position of the vehicle is automatically engaged. If the driver then wants to continue to drive, he must first leave the actually indicated driving position and select it again or select another driving position. This generally leads to confusion and is uncomfortable.

In order to avoid this, it can first be checked according to a special embodiment of the invention whether the gear selection device is set to neutral. If this is not so, the gear selection device can be set to neutral before the engine is started or the transmission line can be uncoupled. For example, when the ignition key is rotated to the "ignition on" position, the vehicle brake can be operated and the clutch can be opened up. This is particularly advantageous in the case of a vehicle with an automated standard transmission wherein when the engine is switched off, the first gear is engaged as an additional safety function.

According to another advantageous embodiment of the present invention, the vehicle brake is released after the engine is started. The release of the vehicle brake can take place as a reaction to the operation of a pedal, for example, an accelerator or brake pedal.

As discussed above, the operation of the vehicle brake takes place by way of external power; that is, the braking pressure or the braking energy to be applied for the vehicle brake—irrespectively of whether it is operated electrically, pneumatically or hydraulically—must be generated by way of a corresponding secondary device in the vehicle. This requires energy even before the engine is started, which can be provided only from a battery. For this reason, it is advisable that a service brake not be left activated for too long without any engine operation. A preferred embodiment of the invention is therefore characterized in that the vehicle brake will be released again if, after a certain time period after the activation of the vehicle brake, the engine has not been started. As an alternative, a parking brake can be operated, for which only the operating process itself requires energy; but after the operation, the parking brake is held in a locked condition like a conventional hand brake. Reference is made in this respect to German Patent document DE 196 32 863 A1.

With respect movement of the vehicle without engine power (pushing, towing, staying in a repair shop, etc.), it may also be required to render the service brake inoperative—possibly manually—in order to permit the moving of the vehicle in certain situations.

On the whole, the present invention provides a cost-effective, simple, safety and comfort increasing process for starting the engine of a vehicle. In particular, the operating comfort during the vehicle start is increased, without requiring the driver to carry out additional actions before the vehicle start. Furthermore, safety is always ensured by avoiding faulty operations and a rolling away of the vehicle when the vehicle is started.

Other objects, advantages and novel features of the present invention will become apparent from the following detailed description of the invention when considered in conjunction with the accompanying drawings.

DETAILED DESCRIPTION OF THE DRAWINGS

The prerequisite for implementing the process is a vehicle brake, which can be operated by way of external power. Such vehicle brakes exist in most current vehicles in the form of brake control systems. In this case, a sufficient hydraulic pressure for a hydraulic brake circuit is provided—usually by way of a separate pump—and this hydraulic pressure is modulated corresponding to the braking demands by way of valves. Naturally, any other vehicle brake can be used which can be operated by way of external power, such as a purely electric brake.

Figure 1:
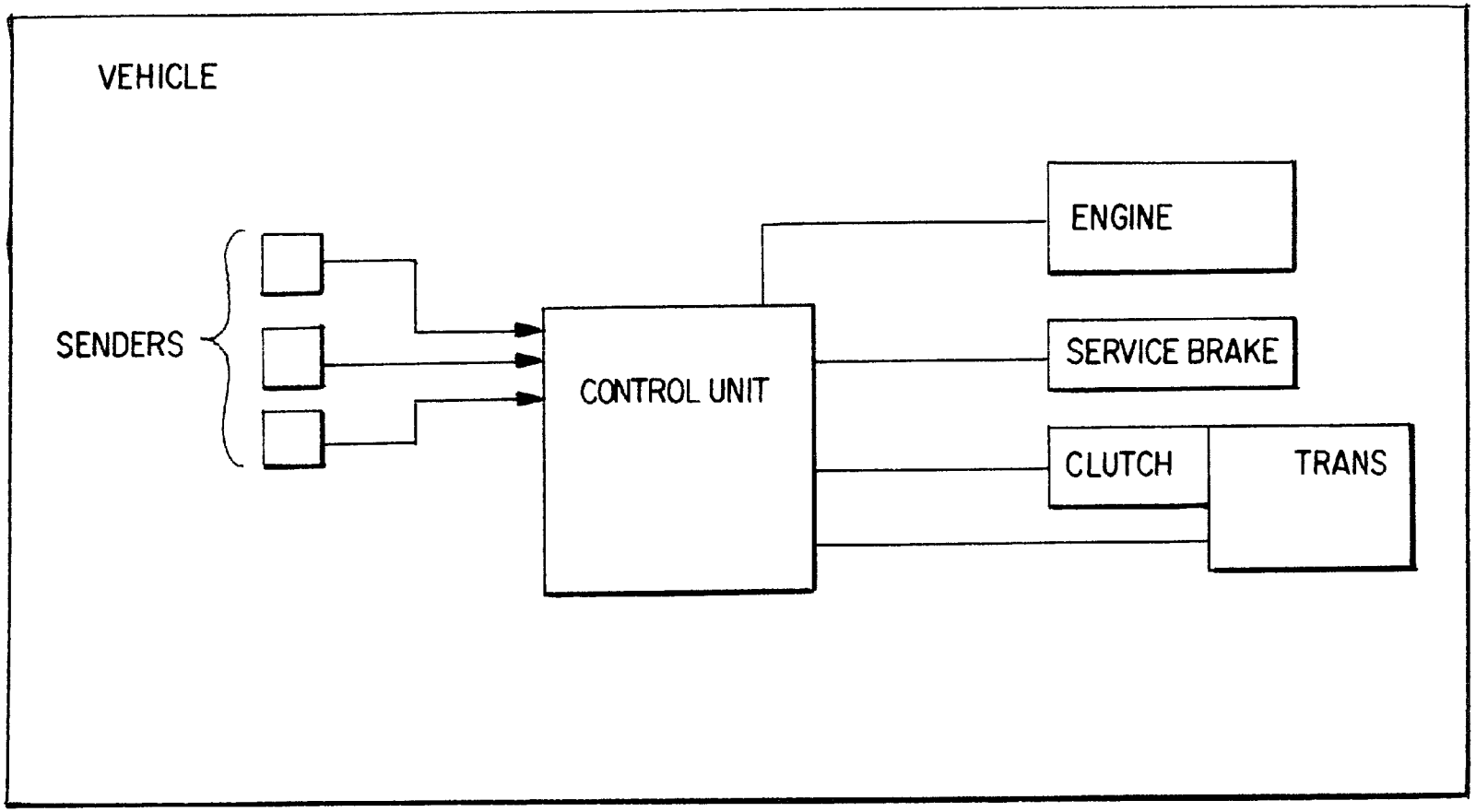
FIG. 1 is a schematic block diagram of a vehicle according to the present invention in which the engine starting process can be performed.

Referring to FIG. 1, there is shown a schematic block diagram of a vehicle equipped with an engine, vehicle brake, clutch and transmission, as well as various sensors. A control unit, for example a microprocessor based control unit, receives input signals from the sensors and controls the operation of the various vehicle components as will be discussed below.

Figure 2:
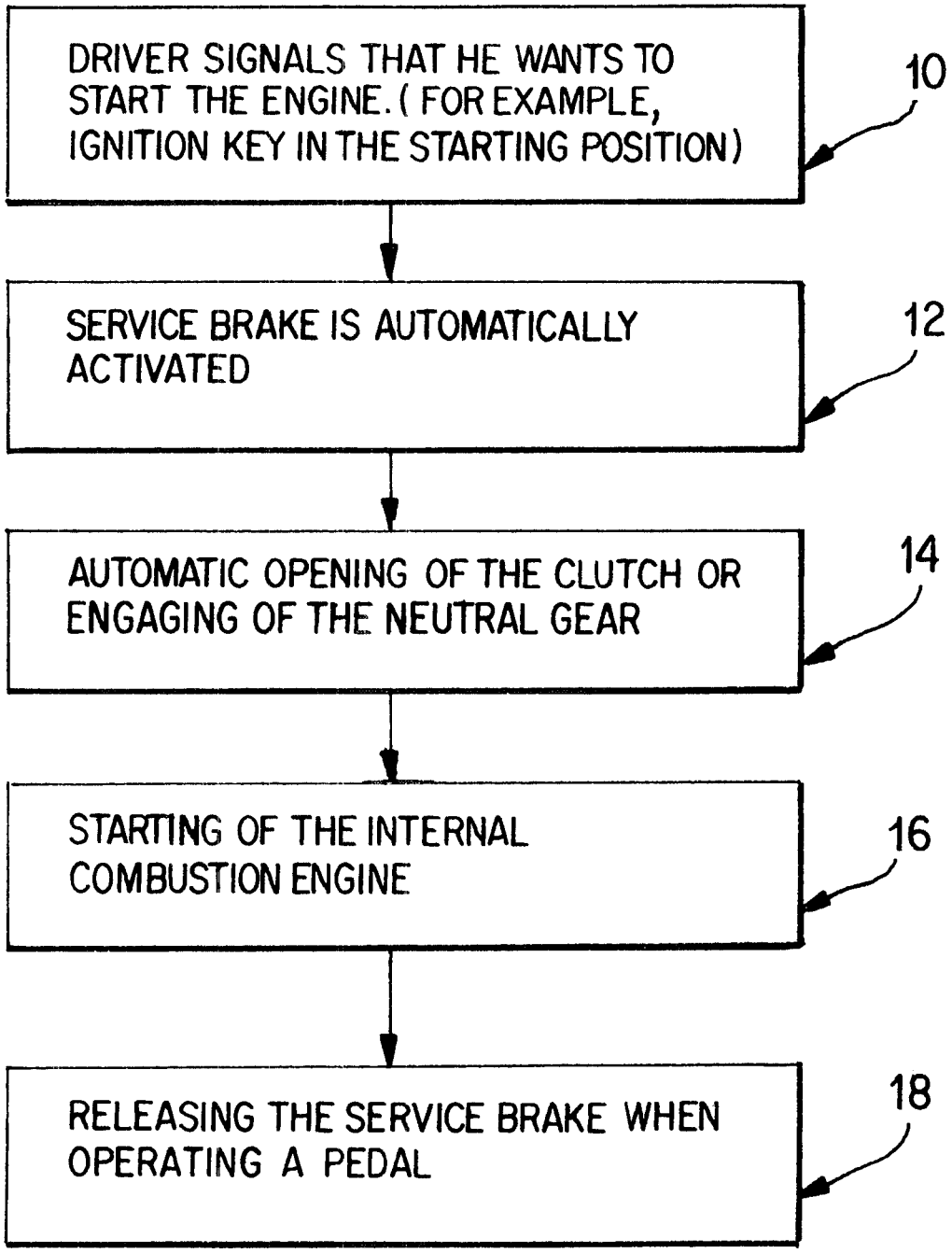
FIG. 2 is a flow chart of the process to be performed when starting the engine of the vehicle according to an embodiment of the present invention.

An embodiment of the process according to the invention will now be explained with respect to FIG. 2. In order to perform the process, it is necessary to evaluate the sensors which indicate an imminent engine start. For example, a remote operating signal for unlocking or releasing a vehicle door can be evaluated. In addition, it is contemplated to evaluate the door opening switch. In the case of the present process, it is checked whether the ignition key was rotated into the starting position ("ignition on" position). If this is so, a corresponding signal is transmitted to the control unit which draws a conclusion about an imminent start of the engine (step 10).

Subsequently, the service brake is automatically activated in step 12.

The present process is used in the case of a vehicle with an automated standard transmission, in which case the first gear is engaged when the vehicle is switched off. For this reason, after the automatic activation of the service brake, the clutch is automatically opened in step 12. As an alternative, the neutral gear can be engaged.

This process step is now followed in step 16 by the start of the internal-combustion engine, which, because of the preceding measures, cannot result in an immediate movement of the vehicle.

After the start of the internal-combustion engine, the service brake is then released in step 18 if any pedal of the vehicle, such as the accelerator pedal or the brake pedal, is operated. By operating these pedals, the driver signals that he is in a ready-to-drive condition and has control over the vehicle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A starting process for a vehicle equipped with an engine, a transmission and a vehicle brake operable via external power, the process comprising the acts of:

sensing an imminent start of the engine of the vehicle; and actuating the vehicle brake by way of the external power before starting the engine in order to secure movement of the vehicle;

wherein the act of sensing the imminent starting of the engine is performed by detecting one of the following acts:

an unlocking of the vehicle;

an opening of a vehicle door;

a driver seat occupation; and an operation of an ignition key or ignition/start system.

2. The process according to claim 1, wherein the vehicle brake is one of a service brake and parking brake.

3. The process according to claim 2, wherein the act of sensing the imminent starting of the engine is performed by detecting one of the following acts:

an unlocking of the vehicle;

an opening of a vehicle door;

a driver seat occupation; and an operation of an ignition key or ignition/start system.

4. The process according to claim 1, further comprising the acts of:

checking whether a gear selection device of the vehicle is in a neutral position; and if not, setting the gear selection device to neutral or uncoupling the transmission from the engine.

5. The process according to claim 1, further comprising the act of releasing the vehicle brake after starting the engine.

6. The process according to claim 5, wherein said releasing act is not performed until a vehicle pedal is operated.

7. The process according to claim 1, further comprising the act of releasing the vehicle brake after its actuation if, after a defined time period, the engine has not started.

8. A starting process for a vehicle equipped with an engine, a transmission and a vehicle brake operable via external power, the process comprising the acts of:

sensing an imminent start of the engine of the vehicle; and actuating the vehicle brake by way of the external power before starting the engine in order to secure movement of the vehicle;

further comprising the acts of:

checking whether a gear selection device of the vehicle is in a neutral position; and if not, setting the gear selection device to neutral or uncoupling the transmission from the engine.

9. The process according to claim 8, further comprising the act of releasing the vehicle brake after starting the engine.

10. The process according to claim 9, wherein said releasing act is not performed until a vehicle pedal is operated.

11. The process according to claim 8, further comprising the act of releasing the vehicle brake after its actuation if, after a defined time period, the engine has not started.

12. A starting process for a vehicle equipped with an engine, a transmission and a vehicle brake operable via external power, the process comprising the acts of:

sensing an imminent start of the engine of the vehicle; and actuating the vehicle brake by way of the external power before starting the engine in order to secure movement of the vehicle;

further comprising the act of releasing the vehicle brake after starting the engine.

13. The progress according to claim 12, wherein said releasing act is not performed until a vehicle pedal is operated.

14. The process according to claim 13, further comprising the act of releasing the vehicle brake after its actuation if, after a defined time period, the engine has not started.

15. The process according to claim 12, further comprising the act of releasing the vehicle brake after its actuation if, after a defined time period, the engine has not started.

16. A starting process for a vehicle equipped with an engine, a transmission and a vehicle brake operable via external power, the process comprising the acts of:

sensing an imminent start of the engine of the vehicle; and actuating the vehicle brake by way of the external power before starting the engine in order to secure movement of the vehicle;

further comprising the act of releasing the vehicle brake after its actuation if, after a defined time period, the engine has not started.

17. A starting process for a vehicle equipped with an engine, a transmission and a vehicle brake operable via external power, the process comprising the acts of:

sensing an imminent start of the engine of the vehicle; and actuating the vehicle brake by way of the external power before starting the engine in order to secure movement of the vehicle;

further comprising the act of preventing manual operation of the parking brake during the process.

18. A computer product, comprising a computer readable medium having stored thereon program code segments that:

detect an imminent start of a vehicle engine based on sensed signals of vehicle conditions; and signal the activation of a vehicle brake before a starting of the engine;

further comprising program code segments that determine whether a gear selection device is in a neutral position and, if not, signal the setting of the gear selection device to the neutral position or an uncoupling of the transmission line.

19. A computer product, comprising a computer readable medium having stored thereon program code segments that:

detect an imminent start of a vehicle engine based on sensed signals of vehicle conditions; and signal the activation of a vehicle brake before a starting of the engine;

further comprising a program code segment that signals the release of the vehicle brake after the start of the engine.

20. The computer product according to claim 19, further comprising a program code segment that inhibits the signal releasing the vehicle brake until a vehicle pedal operation is detected.

21. A computer product, comprising a computer readable medium having stored thereon program code segments that:

detect an imminent start of a vehicle engine based on sensed signals of vehicle conditions; and signal the activation of a vehicle brake before a starting of the engine;

further comprising program code segments that signal the release of the vehicle brake if, after a defined time period after the signal activating the vehicle brake, the vehicle engine has not started.

* * * * *